US008731427B2

(12) United States Patent
Eguchi et al.

(10) Patent No.: US 8,731,427 B2
(45) Date of Patent: May 20, 2014

(54) IMAGE FORMING APPARATUS PERFORMING CONTROL OF CHANGING TARGETS OF POWER SUPPLY FROM CHARGING DEVICE

(75) Inventors: Hiroshi Eguchi, Okazaki (JP); Shigeru Yamazaki, Toyokawa (JP); Tomonobu Tamura, Toyokawa (JP); Yuhei Tatsumoto, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 155 days.

(21) Appl. No.: 13/269,161

(22) Filed: Oct. 7, 2011

(65) Prior Publication Data

US 2012/0093537 A1 Apr. 19, 2012

(30) Foreign Application Priority Data

Oct. 19, 2010 (JP) ..... 2010-234401

(51) Int. Cl.
*G03G 15/00* (2006.01)

(52) U.S. Cl.
USPC ..... 399/88

(58) Field of Classification Search
USPC ..... 399/69, 70, 88, 90
See application file for complete search history.

(56) References Cited

U.S. PATENT DOCUMENTS 7,277,651 B2 * 10/2007 Hanamoto et al. ..... 399/69

FOREIGN PATENT DOCUMENTS

| | | | |
|---|---|---|---|
| JP | 9-109518 | A | 4/1997 |
| JP | 2007-005944 | A1 | 1/2007 |
| JP | 2009-070209 | A | 4/2009 |

OTHER PUBLICATIONS

Office Action (Notice of Grounds of Rejection) dated Nov. 13, 2012, issued in corresponding Japanese Patent Application No. 2010-234401, and an English Translation thereof. (8 pages).

* cited by examiner

*Primary Examiner* — Hoang Ngo
(74) *Attorney, Agent, or Firm* — Buchanan Ingersoll & Rooney PC

(57) ABSTRACT

An image forming apparatus includes a charging device for performing charging and discharging using a power storage device, and a plurality of loads each serving as a target of power supply from said charging device and being used in operation of the image forming apparatus. The image forming apparatus obtains information about an operation status of the image forming apparatus and sets priorities for being a target of power supply from the charging device for the plurality of loads, according to the obtained information. The image forming apparatus controls power supply operation of the charging device according to the information about the remaining capacity of the power storage device and the set priorities.

12 Claims, 6 Drawing Sheets

FIG.6
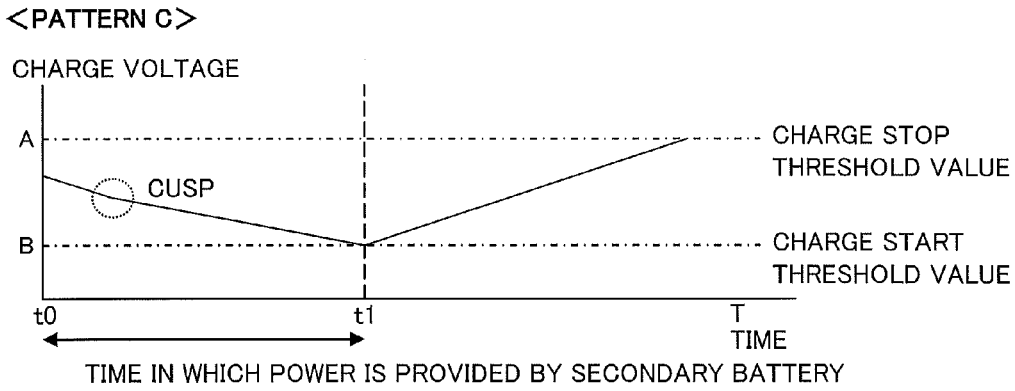
FIG.7
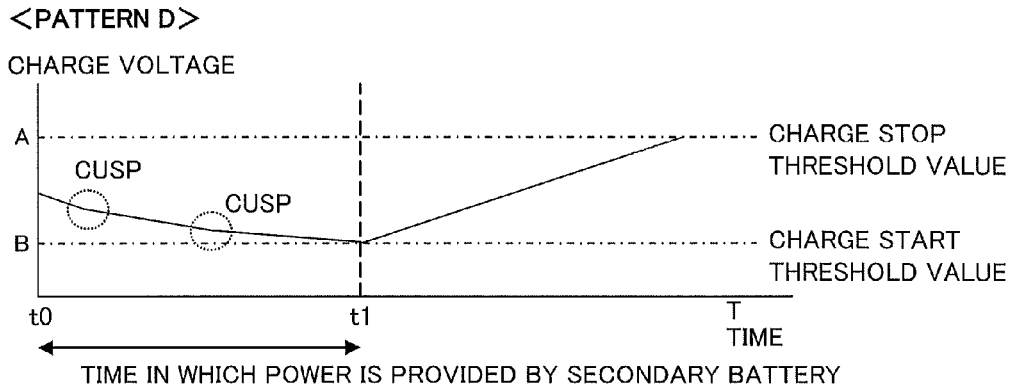
FIG.8
| CONDITIONS / POWER SUPPLY TARGETS | CHARGE POWER (PREDETERMINED VALUE OR LOWER) TIME INFORMATION (DAYTIME) | CHARGE POWER (PREDETERMINED VALUE OR LOWER) TIME INFORMATION (NIGHTTIME) |
|---|---|---|
| POWER MANAGEMENT CPU | 1 | 1 |
| WIRELESS COMMUNICATION MODULE | 2 | 3 |
| HUMAN DETECTION SENSOR | 3 | 4 |
| LIGHT SENSOR | 6 | 2 |
| DISPLAY PANEL | 5 | 6 |
| DOCUMENT DETECTION SENSOR | 4 | 5 |

FIG.10

| CONDITIONS / POWER SUPPLY TARGETS | CHARGE POWER (PREDETERMINED VALUE OR LOWER) | CHARGE POWER (PREDETERMINED VALUE OR LOWER) | CHARGE POWER (PREDETERMINED VALUE OR LOWER) |
|---|---|---|---|
| | TIME INFORMATION (DAYTIME) | TIME INFORMATION (DAYTIME) | TIME INFORMATION (DAYTIME) |
| | NO USE HISTORY LEARNING | HISTORY LEARNING A | HISTORY LEARNING B |
| POWER MANAGEMENT CPU | 1 | 1 | 1 |
| WIRELESS COMMUNICATION MODULE | 2 | 5 | 4 |
| HUMAN DETECTION SENSOR | 3 | 2 | 2 |
| LIGHT SENSOR | 6 | 6 | 6 |
| DISPLAY PANEL | 5 | 4 | 5 |
| DOCUMENT DETECTION SENSOR | 4 | 3 | 3 |

IMAGE FORMING APPARATUS PERFORMING CONTROL OF CHANGING TARGETS OF POWER SUPPLY FROM CHARGING DEVICE

This application is based on Japanese Patent Application No. 2010-234401 filed with the Japan Patent Office on Oct. 19, 2010, the entire content of which is hereby incorporated by reference.

BACKGROUND OF THE INVENTION

1. Field of the Invention

The present invention relates to an image forming apparatus and more particularly to an image forming apparatus having a charging device.

2. Description of the Background Art

Some image forming apparatuses (for example, MFPs (Multi Function Peripherals) having a scanner function, a facsimile function, a copy function, a printer function, a data communication function, and a server function, facsimile machines, copiers, and printers) include charging devices. Such an image forming apparatus can use charge power output from a charging device, in place of electricity from a commercial power supply, in each unit of the apparatus. The charge power can be used in operation in an energy-saving mode, for example, during a sleep mode.

Document 1 below discloses an image forming apparatus using an auxiliary power supply having a secondary battery as one of power supplies for a scanner unit. When scanning a document, the image forming apparatus determines whether to supply auxiliary power or to supply AC power to the scanner unit depending on the amount of stored power in the auxiliary power supply.

Document 2 below discloses a printer including a battery and capable of print operation with power supply from the battery. The printer allows power supply from the battery depending on the remaining battery level so that the print operation is not interrupted halfway through printing.

[Document 1] Japanese Laid-Open Patent Publication No. 2007-5944

[Document 2] Japanese Laid-Open Patent Publication No. Hei 9-109518

In such an image forming apparatus having a charging device, the more are the loads to be supplied with charge power, the larger is the amount of power the charging device needs to store. To store the large amount of power, it is necessary to use, for example, a secondary battery having a large capacity. Then, the cost required for the charging device increases. In this regard, to prevent the cost increase, it is desirable to use a secondary battery having a small capacity, for example. When a secondary battery having a small capacity is used, the number of power supply targets should be minimized. In addition, when the charge remaining amount of the secondary battery reaches a predetermined value or lower, the power supply from the charging device should be stopped and switched to power supply from AC power. In this case, however, the energy-saving performance as expected with the use of the charging device is impaired. In view of such a trade-off between the low cost performance and the energy-saving performance, it is desired to improve both of them.

Neither Document 1 nor Document 2 above discloses an effective solution to this problem.

SUMMARY OF THE INVENTION

In accordance with an aspect of the present invention, an image forming apparatus includes a charging device for performing charging and discharging using a power storage device, a plurality of loads each serving as a target of power supply from the charging device and being used in operation of the image forming apparatus, a first obtaining unit for obtaining information about a remaining capacity of the power storage device, a second obtaining unit for obtaining information about an operation status of the image forming apparatus, a setting unit for setting priorities for being a target of power supply from the charging device for the plurality of loads, according to the information obtained by the second obtaining unit, and a control unit for performing control of power supply operation of the charging device according to the information obtained by the first obtaining unit and the priorities set by the setting unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 is a graph showing an example of charge voltage of the secondary battery changing over time when power supply control is performed.

FIG. 7 is a graph showing another example of charge voltage of the secondary battery changing over time when power supply control is performed.

FIG. 8 is a table showing an example of priority information.

FIG. 10 is a table showing an example of priority information according to a modified embodiment.

DESCRIPTION OF THE PREFERRED EMBODIMENTS

Embodiments of the image forming apparatus according to the present invention will now be described.

The image forming apparatus is a multi-function peripheral (MFP) including the scanner function, the copying function, the printer function, the facsimile transmitting/receiving function, the data communicating function, and the server function. With the scanner function, the image forming apparatus reads an image from a document which has been set, and stores the read image in a hard disk drive (HDD) or the like. With the copying function, the device further prints the image on a sheet of paper or the like. With the printer function, on receipt of a print instruction from an external terminal such as a personal computer (PC), the apparatus prints an image on a sheet of paper on the basis of the instruction. With the facsimile transmitting/receiving function, the device receives facsimile data from an external facsimile machine or the like and stores the data in a HDD or the like. With the data communicating function, the device transmits data to or receives data from an external device connected thereto. With the server function, the apparatus allows a plurality of users to share, e.g., data stored in a HDD or the like.

The image forming apparatus includes a charging device. The charging device performs charging/discharging of a power storage device. The power storage device is, for example, a secondary battery. The image forming apparatus can operate in an energy-saving mode (hereinafter referred to as the saving mode) provided an one of operation modes. For example, in operation in the saving mode, the image forming apparatus can operate using charge power supplied from the charging device for a variety of loads provided in the image forming apparatus.

The image forming apparatus performs control of changing the targets of power supply from the charging device. More specifically, the priorities for targets of power supply from the charging device are set for a plurality of loads in the image forming apparatus. The priorities are set, for example, according to the preset conditions depending on the remaining capacity of the secondary battery, the time information associated with the use status of the image forming apparatus, and the like. Then, ON/OFF of the power supply targets is switched according to the priorities. The power supply targets are thus changed. As a result, the capacity of the secondary battery of the charging device can be relatively reduced while the energy-saving performance is achieved.

[Embodiments]

Figure 1:
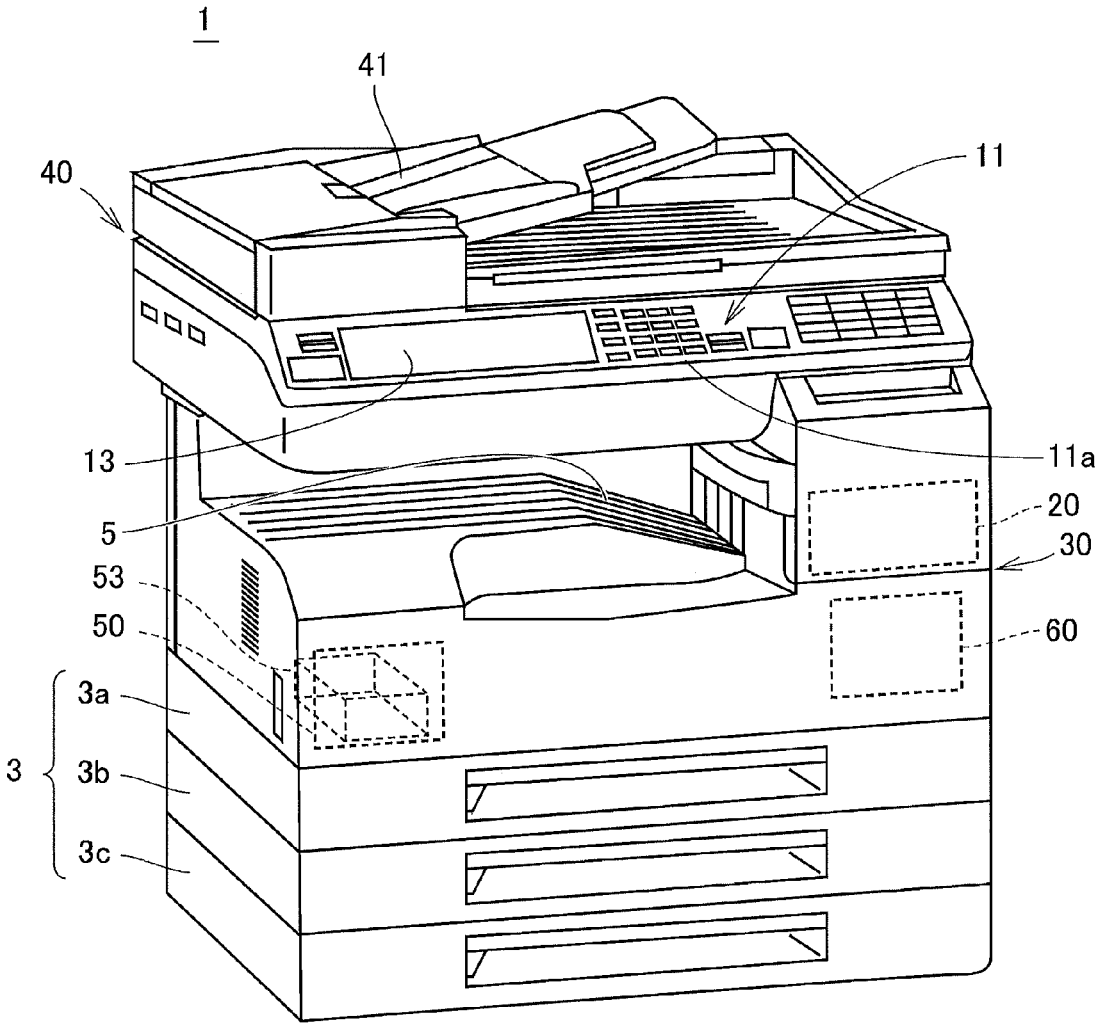
FIG. 1 is a perspective view showing an image forming apparatus in an embodiment of the present invention.

FIG. 1 is a perspective view showing an image forming apparatus in an embodiment of the present invention.

[Configuration of Image Forming Apparatus 1]

As shown in FIG. 1, an image forming apparatus 1 includes a paper-feed cassette 3, a paper output tray 5, an operation display unit 11, a control unit (hereinafter also referred to as CPU) 20, an image forming unit 30, an image scanning unit 40, a charging device 50, and a power supply unit 60. Control unit 20, image forming unit 30, image scanning unit 40, charging device 50, and power supply unit 60 are arranged in the casing of image forming apparatus 1.

Image forming apparatus 1 has three paper-feed cassettes 3 (paper-feed cassettes 3*a*, 3*b*, 3*c*). Paper-feed cassettes 3 are arranged in the lower portion of image forming apparatus 1 so as to be removable from the casing of image forming apparatus 1. Paper of different sizes (B5 size, A4 size, A3 size, etc.) and paper in different states is loaded in paper-feed cassettes 3. Paper loaded in each paper-feed cassette 3 is fed sheet by sheet from paper-feed cassette 3 and sent to image forming unit 30. The number of paper-feed cassettes 3 is not limited to three and may be more than or less than three.

Paper output tray 5 is arranged above the part where image forming unit 30 is accommodate and below the part where image scanning unit 40 is arranged in the casing of image forming apparatus 1. Paper having an image formed thereon by image forming unit 30 is discharged from the inside of the casing to paper output tray 5.

Operation display unit 11 is arranged on the front side at the upper portion of image forming apparatus 1. A plurality of operation buttons 11*a* that can be pressed and operated by a user are arranged in operation display unit 11. A display panel 13 is also arranged in operation display unit 11. Display panel 13 is, for example, an LCD (Liquid Crystal Display) including a touch panel. Display panel 13 displays a guide screen to a user and displays operation buttons to accept touch operation from a user. Display panel 13 is controlled by control unit 20 for display. Operation display unit 11 accepts operation input from a user. When operation buttons 11*a* or display panel 13 is operated by a user, operation display unit 11 sends an operation signal or a predetermined command corresponding to the operation to control unit 20. In other words, the user operates operation display unit 11 to allow image forming apparatus 1 to execute a variety of operations.

Image forming unit 30 mainly has a toner image forming unit (not shown), a paper conveyance unit (not shown), and a fixing device (not shown). Image forming unit 30 forms an image on paper by electrophotography.

The paper conveyance unit mainly includes a paper-feed roller, a conveyance roller, and motors for driving them. The paper conveyance unit feeds paper from paper-feed cassette 3 and conveys paper in the inside of the casing of image forming apparatus 1. The paper conveyance unit outputs paper having an image formed thereon from the casing of image forming apparatus 1 to paper output tray 5.

The fixing device has a heating roller and a pressing roller. The fixing device conveys paper having a toner image sandwiched between the heating roller and the pressing roller, and heats and presses the paper. Accordingly, the fixing device causes toner adhered to paper to fuse and fix on the paper thereby forming an image on the paper.

Image scanning unit 40 is arranged in the upper portion of the casing of image forming apparatus 1. Image scanning unit 40 has an ADF (Automatic Document Feeder) 41. Image scanning unit 40 executes the scanner function. Image scanning unit 40 scans and reads a document arranged on a transparent platen using an image pickup device such as a contact image sensor to generate image data. While ADF 41 successively takes in plural sheets of a document set in a document tray, image scanning unit 40 scans the document using, for example, a contact sensor and generates image data thereof.

Charging device 50 has a secondary battery (an example of the power storage device) 53 as a power storage device. The configuration of charging device 50 will be detailed later.

Power supply unit 60 is provided in the inside of the casing of image forming apparatus 1. Power supply unit 60 includes an AC-DC converter. Power supply unit 60 is connected to an external commercial power source and supplies power to each unit of image forming apparatus 1, such as control unit 20, image forming unit 30, image scanning unit 40, and charging device 50, based on the commercial power source.

Figure 2:
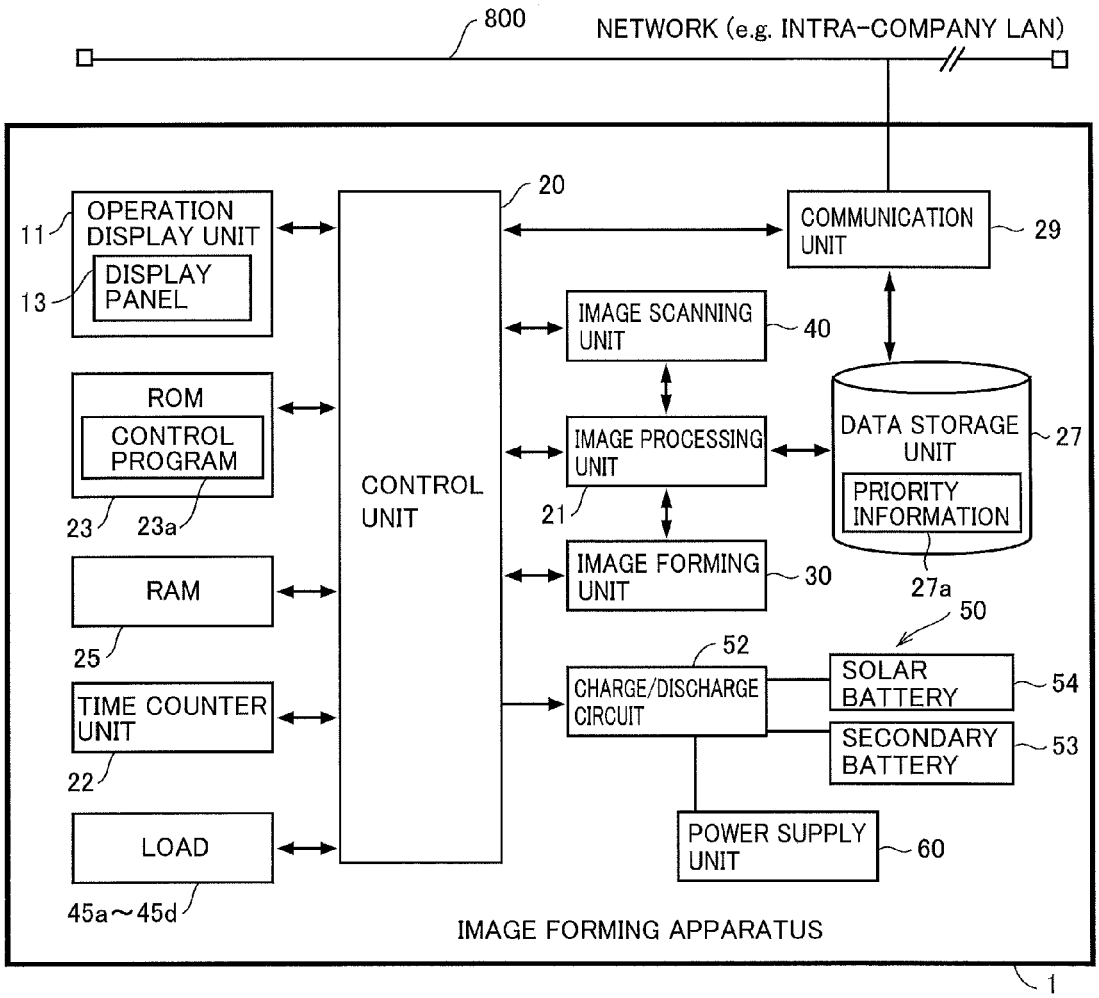
FIG. 2 is a block diagram showing a hardware configuration of the image forming apparatus.

FIG. 2 is a block diagram showing a hardware configuration of image forming apparatus 1.

As shown in FIG. 2, image forming apparatus 1 has, in addition to the units as described above, an image processing unit 21, a time counter unit 22, a ROM 23, a RAM 25, a data storage unit 27, and a communication unit 29. Those units of image forming apparatus 1 are connected, for example, to a system bus and can communicate with each other. Image forming apparatus 1 has loads 45*a* to 45*d*.

Image processing unit 21 is, for example, an MPU (Micro Processing Unit) performing image processing. Image processing unit 21 performs image processing on image data generated by image scanning unit 40 and data of an image formed by image forming unit 30, for example, under the control of CPU 20.

Time counter unit 22 is, for example, a clock IC and has a time counting function and a timer function.

ROM 23 is, for example, a flash ROM (Flash Memory). Data to be used to perform operation of image forming apparatus 1 and a variety of control programs 23*a* are stored in ROM 23. The function settings data of image forming apparatus 1 may be stored in ROM 23. CPU 20 performs data read from ROM 23 and data write into ROM 23. ROM 23 may be non-writable.

RAM 25 is a main memory of CPU 20. RAM 25 is used to store data necessary for CPU 20 to execute control program 23*a*.

Data storage unit 27 is, for example, an HDD and stores data of a print job externally sent through communication unit 29 and image data scanned by image scanning unit 40. Data storage unit 27 stores the settings information of image forming apparatus 1 and control programs for performing a variety of operations of image forming apparatus 1.

In the present embodiment, priority information 27*a* is stored in data storage unit 27. Priority information 27*a* is read and used by CPU 20 when charging device 50 is controlled as described later.

Communication unit 29 is configured to include, for example, a hardware unit such as an NIC (Network Interface Card) and a software unit for communication using a predetermined communication protocol. Communication unit 29 connects image forming apparatus 1 to a network 800. Thus, image forming apparatus 1 can communicate with an external device such as a PC (not shown) or a server (not shown) connected to network 800. Network 800 is, for example, a Local Area Network (LAN). Image forming apparatus 1 can receive a print job from the PC or server. Image forming apparatus 1 can transmit image data scanned by image scanning unit 40 to the PC or transmit the image data via email through a mail server (not shown). Communication unit 29 may be configured to be able to wirelessly connect to network 800.

CPU 20 performs centralized control of a variety of operations of image forming apparatus 1 by executing control programs 23*a* stored in ROM 23, RAM 25, data storage unit 27, or the like. When an operation signal is transmitted from operation display unit 11 or an operation command is transmitted from an external PC, CPU 20 executes a predetermined control program 23*a* in response. Thus, a predetermined function of image forming apparatus 1 is executed in accordance with the user's operation on operation display unit 11.

CPU 20 controls image forming apparatus 1 based on several operation modes. The operation modes include, for example, a print mode, a scan mode, a standby mode, and a saving mode. The print mode is an operation mode when an image is formed by image forming unit 30. The scan mode is an operation mode when a document is scanned by image scanning unit 40. The standby mode is an operation mode when an operation such as image formation or document scanning is not started. The saving mode is an operation mode in which power consumption is reduced by supplying power to only part of image forming apparatus 1, for example, during times when image forming apparatus 1 is less likely to be used. CPU 20 may change the operation mode to the saving mode, for example, during operation in the standby mode when the image forming apparatus is not driven for a certain period of time.

In the following description, when the operation mode of image forming apparatus 1 is not the saving mode (an example of in operation of the image forming apparatus), for example, when image forming apparatus 1 is in print operation (the operation mode is the print mode) or on standby (the operation mode is the standby mode), this state is also referred to as image forming apparatus 1 being in normal operation. When image forming apparatus 1 is in a state in which it is driven in the saving mode, that is, in the operation state that is not the normal operation (another example of in operation of the image forming apparatus), this state is also referred to as image forming apparatus 1 being in sleep mode.

[Configuration of Charging Device 50]

As shown in FIG. 2, charging device 50 includes, in addition to secondary battery 53, a charge/discharge circuit 52, a solar battery 54, and a switch unit 57.

Figure 3:
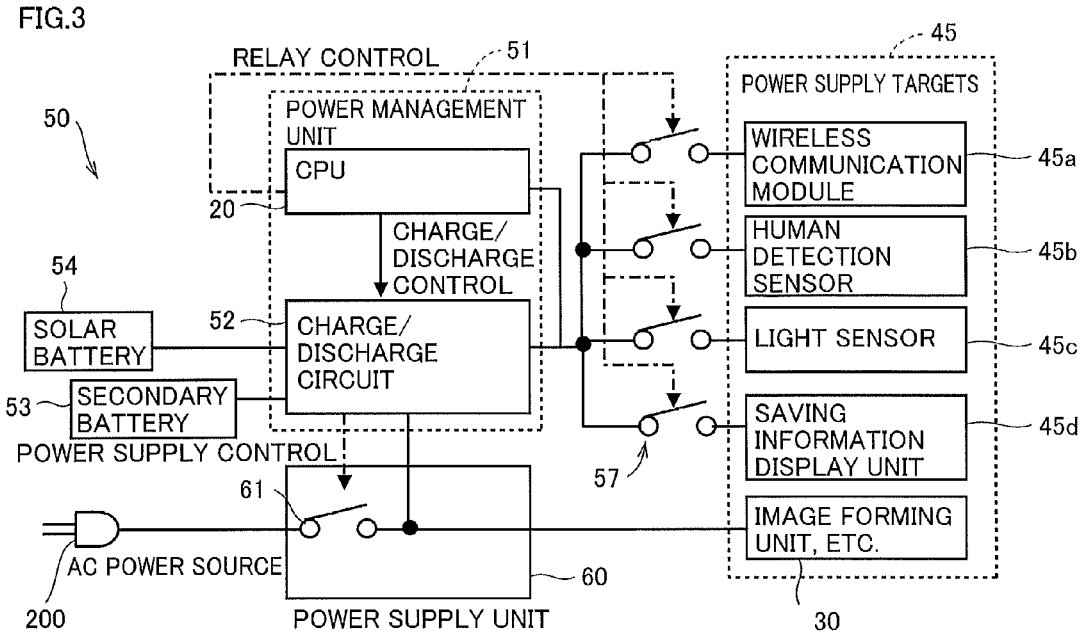
FIG. 3 is a block diagram showing a configuration of a power supply circuit to each unit of the image forming apparatus.

FIG. 3 is a block diagram showing a configuration of a power supply circuit to each unit of image forming apparatus 1.

As shown in FIG. 3, the power supply circuit of image forming apparatus 1 includes power supply unit 60 and charging device 50. Power supply unit 60 and charging device 50 supply power to power supply targets (an example of a plurality of loads) 45 of image forming apparatus 1 when image forming apparatus 1 is in operation or when image forming apparatus 1 is in normal operation or in sleep mode. Power supply target 45 is driven with power supply from one of power supply unit 60 and charging device 50 to allow image forming apparatus 1 to execute a variety of operations. In other words, power supply target 45 is used during operation of image forming apparatus 1.

Examples of power supply targets 45 mainly include a wireless communication module (an exemplary load) 45*a*, a human detection sensor (an exemplary load) 45*b*, a light sensor (an exemplary load) 45*c*, a saving information display unit (an exemplary load) 45*d*, and image forming unit (an exemplary load) 30. Each of power supply targets 45 is connected to power supply unit 60 and charging device 50.

Wireless communication module 45*a* allows, for example, execution of wireless communication with an external device. Human detection sensor 45*b* detects, for example, the location of a person nearby or the approach of a person by infrared light, ultrasound, or visible light. Light sensor 45*c* is, for example, an illumination sensor to detect the ambient brightness of image forming apparatus 1. Saving information display unit 45*d* mainly displays information about the energy saving (saving) operation. Saving information display unit 45*d* is, for example, display panel 13 which displays that the operation is in the saving mode. Saving information display unit 45*d* may be a light source which turns on to indicate that the operation is in the saving mode.

The loads serving as power supply targets 45 may include a document set sensor. The document set sensor is, for example, a sensor which detects whether a document is set in the ADF.

Wireless communication module 45*a*, human detection sensor 45*b*, light sensor 45*c*, and saving information display unit 45*d* are each connected to the corresponding one of a plurality of switches in switch unit 57. Each switch in switch unit 57 is connected to charge/discharge circuit 52. More specifically, each switch in switch unit 57 is connected between charge/discharge circuit 52 and wireless communication module 45*a*, human detection sensor 45*b*, light sensor 45*c*, or saving information display unit 45*d*. When each switch turns on, of wireless communication module 45*a*, human detection sensor 45*b*, light sensor 45*c*, and saving information display unit 45*d*, the one that is connected to the turned-on switch is connected to charge/discharge circuit 52. When the load of power supply target 45 is connected with charge/discharge circuit 52, the load can be supplied with power from charging device 50.

Charge/discharge circuit 52 is connected to switch unit 57, secondary battery 53, and solar battery 54. Charge/discharge circuit 52 is connected to power supply unit 60. Charge/discharge circuit 52 is controlled by CPU 20 and performs charging of secondary battery 53 using power output from power supply unit 60, supplies power output from power supply unit 60 to power supply target 45, and supplies power discharged from secondary battery 53 to power supply target 45. In other words, charge/discharge circuit 52 and CPU 20 controlling charge/discharge circuit 52 function as a power management unit 51.

CPU 20 is connected to charge/discharge circuit 52 and is driven with power supplied from charge/discharge circuit 52. In other words, CPU 20 is also one of the loads.

Secondary battery 53 is, for example, a lithium-ion secondary battery. Secondary battery 53 may be, for example, a lead-acid battery or any other kind of secondary battery.

Solar battery 54 receives light to convert the light energy into electric power for output to charge/discharge circuit 52. Power output from solar battery 54 is used for charging secondary battery 53 or is supplied to power supply target 45 based on the control of CPU 20.

Power supply unit 60 is connected to commercial power source 200 which is an AC power supply. Power supply unit 60 has a switch 61 to turn on/off AC power supply from commercial power source 200. The on/off of switch 61 is controlled by CPU 20 through charge/discharge circuit 52. In other words, power management unit 51 performs power supply control of power supply unit 60. The on/off of switch 61 may be controlled by CPU 20 not through charge/discharge circuit 52.

Here, CPU 20 performs relay control of switch unit 57. The relay control is performed for each switch of switch unit 57. The turning on/off each switch turns on/off power supply to each load 45*a* to 45*d* as a power supply target 45 connected to the switch. Although not shown in FIG. 3, the switches of switch unit 57 may also be provided in a power supply path from charge/discharge circuit 52 to CPU 20 and a power supply path from charge/discharge circuit 52 and power supply unit 60 to image forming unit 30, so that CPU 20 performs the relay control.

CPU 20 performs control of power supply as described below. More specifically, when image forming apparatus 1 is in normal operation, electric power from commercial power source 200 is supplied to each power supply target 45 through power supply unit 60. Here, electric power from solar battery 54 or power supply unit 60 is supplied to secondary battery 53 to charge secondary battery 53. On the other hand, when image forming apparatus 1 is in sleep mode, that is, when the operation mode is the saving mode, for example, electric power stored in secondary battery 53 (also referred to as charge power) is supplied to each power supply target 45. Here, power supply from power supply unit 60, that is, power supply from commercial power source 200 is cut off. Accordingly, in operation in the saving mode, the consumption of power from commercial power source 200 is 0 W.

[Operation of Charging Device 50]

The operation of charging device 50 in the present embodiment will be described below. Secondary battery 53 can discharge when its remaining capacity (also referred to as the remaining amount or the power storage amount) is sufficient, and secondary battery 53 is charged when the remaining capacity becomes low. The control on charge and discharge of secondary battery 53 is performed by CPU 20 depending on the remaining capacity of secondary battery 53. In the present embodiment, CPU 20 performs control on charge and discharge of secondary battery 53 based on voltage (charge voltage) of secondary battery 53. Specifically, CPU 20 starts charging of secondary battery 53 when the voltage of secondary battery 53 falls below a predetermined charge start threshold value. On the other hand, CPU 20 terminates the charging control of secondary battery 53 when the voltage of secondary battery 53 reaches a predetermined charge end threshold value.

In normal operation and when secondary battery 53 is charged to such a degree that the charge voltage reaches the charge end threshold voltage, if the operation mode changes to the saving mode, then the charge voltage of secondary battery 53 changes as follows.

Figure 4:
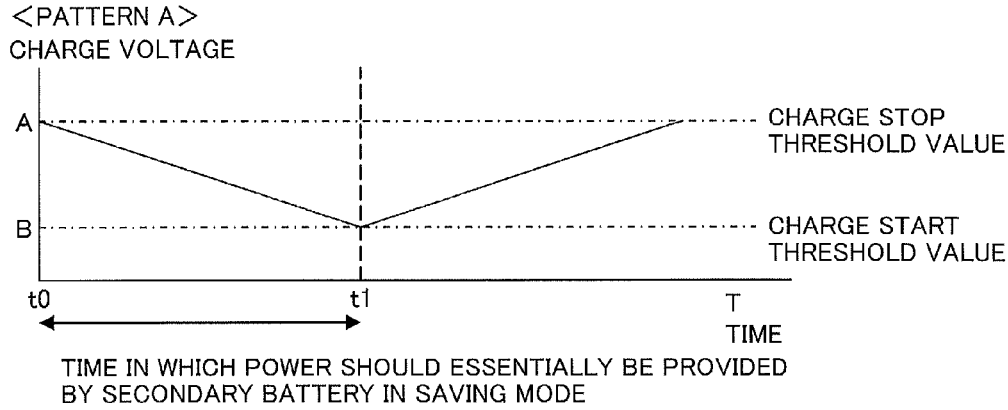
FIG. 4 is a graph showing an example of charge voltage of a secondary battery changing over time.

FIG. 4 is a graph showing an example of the charge voltage of secondary battery 53 changing over time.

In FIGS. 4 to 7, the transition of the charge voltage is graphed on a straight line for the sake of illustration. It is noted that the actual transition of the charge voltage is represented as a smooth curve, in particular, in the vicinity of the charge start threshold value B.

In the present embodiment, charging device 50 supplies power discharged from secondary battery 53 to power supply target 45 driven at that point of time, for a predetermined period from when the operation mode changes to the saving mode to the next charge start time. Then, the charge power (remaining capacity) of secondary battery 53 decreases over time, and when the charge voltage of the secondary battery falls below the charge start threshold value after the elapse of the predetermined period, or when the operation mode switches to bring image forming apparatus 1 into normal operation, charging device 50 performs charging of secondary battery 53. In other words, when the charge voltage reaches the charge start threshold value, the remaining capacity of secondary battery 53 is almost a minimum.

As shown in FIG. 4, it is assumed that the operation mode changes to the saving mode at time t0, and the next charge start time is time t1. Time t1 is a time when the predetermined period terminates, where time t0 is the point of time when the operation mode changes to the saving mode and discharging starts, that is, when the predetermined period starts. The period from time t0 to time t1 is a predetermined period in which, in the saving mode, the driving power for power supply target 45 should essentially be provided by power from secondary battery 53. In other words, the predetermined period is set to be a period during which secondary battery 53 can discharge, or a period shorter than it, until the charge voltage drops to the charge start threshold value B from the charge end threshold value A, in sleep mode.

At time t0, when discharging of secondary battery 53 is started, the charge voltage has reached the charge end threshold value A. As secondary battery 53 is discharged, the charge voltage decreases over time. Then, at time t1 or later, when the charge voltage drops to the charge start threshold voltage B, charging of secondary battery 53 is started. Once charging is started, the charge voltage of secondary battery 53 increases over time.

At the point of time when the operation mode changes to the saving mode, if the remaining capacity of secondary battery 53 is not accumulated, the charge voltage of secondary battery 53 changes as follows. Here, it is assumed that the remaining capacity of secondary battery 53 is not accumulated to such a degree that can provide the driving power for power supply target 45 for the predetermined period until the next charge start time.

Figure 5:
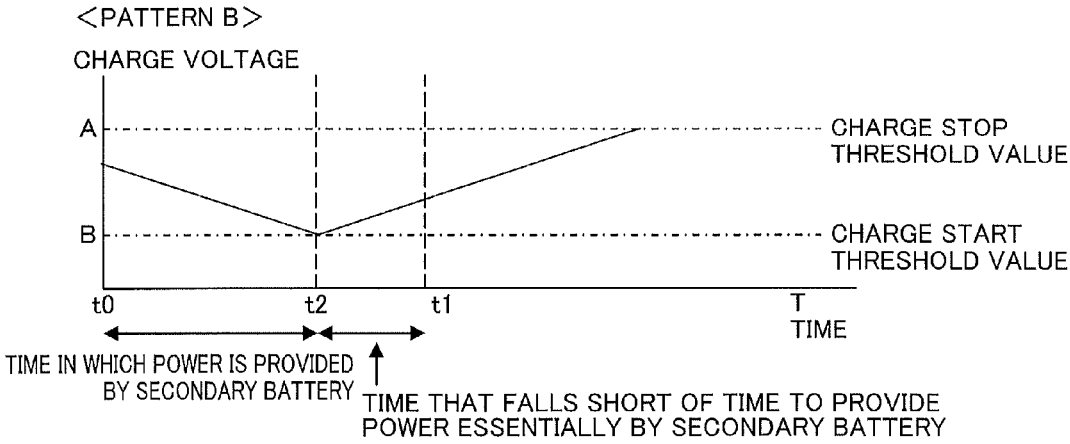
FIG. 5 is a graph showing another example of charge voltage of the secondary battery changing over time.

FIG. 5 is a graph showing another example of the charge voltage of secondary battery 53 changing over time.

In this case, assuming that power supply target 45 consumes power similarly to the case shown in FIG. 4, the remaining capacity decreases over time after discharging of secondary battery 53 is started. Then, the charge voltage drops to the charge start threshold value before the elapse of the predetermined period in which power should essentially be supplied from secondary battery 53. If the charge voltage drops to the charge start threshold value, charging of secondary battery 53 need to be started even before the elapse of the predetermined period.

More specifically, as shown in FIG. 5, when the operation mode changes to the saving mode at time t0, if the charge voltage is lower than the charge start threshold value A, then the charge voltage decreases to the charge start threshold value B at time t2 earlier than time t1. Therefore, at time t2, charging of secondary battery 53 is started. That is, power supply by secondary battery 53 terminates before the elapse of the predetermined period, and charging of secondary battery 53 is performed.

In this manner, if charging is started before the elapse of the predetermined period, the period in which power is supplied from secondary battery 53 is shortened. In other words, in the period in which essentially, power is supposed to be provided from secondary battery 53, power is not provided for a period from time t2 to time t1. If the period in which power is supplied is shortened in this manner, the energy saving effect that should essentially be achieved may be impaired.

In the present embodiment, the priorities for supplying power to the loads of power supply targets 45 are set according to information about the remaining capacity of secondary battery 53 and information about the operation status of image forming apparatus 1. Then, the power supply operation of charging device 50 is controlled according to the set priorities and the remaining capacity of secondary battery 53. The power supply control is performed, for example, by CPU 20 that functions as part of power management unit 51. CPU 20 performs power supply control, for example, by executing a predetermined control program 23*a*.

With the power supply control, power to be supplied to the load having a low priority among the loads of power supply targets 45 is cut off as necessary. The power supply control is performed such that the remaining capacity of secondary battery 53 reaches a predetermined level at the expected next charge start time of secondary battery 53. Here, CPU 20 determines that the charge voltage of the secondary battery reaches a predetermined level when the charge voltage of secondary battery 53 has the charge start threshold value. In other words, CPU 20 performs power supply control such that the charge voltage of secondary battery 53 attains the charge start threshold voltage B when a predetermined period has passed since the operation mode switched to the saving mode. The power supply control is performed such that the remaining capacity of secondary battery 53 is almost a minimum at the next charge start time.

CPU 20 calculates the next charge start time (expected charge start time) when discharging of secondary battery 53 starts, that is, when the operation mode switches to the saving mode. CPU 20 sets, as the expected charge start time, the time after the predetermined period has passed since the operation mode switched to the saving mode. CPU 20 obtains information of the present charge voltage of secondary battery 53, that is, information of the remaining capacity of secondary battery 53.

Here, as illustrated in FIG. 5, when the remaining capacity is not sufficiently accumulated in secondary battery 53, CPU 20 determines that power supply cannot be performed continuously until time t1 if discharging of secondary battery 53 continues under the present conditions. Then, CPU 20 executes power supply control to cut off power supply to the load having the lowest priority among the loads currently receiving power supply. Power supply is cut off by turning off the switch in switch unit 57 that corresponds to the target load. Power supply may be cut off successively for each load or for each of several groups of the loads.

CPU 20 secures the time of discharging in which power should essentially be provided by the secondary battery, by reducing power discharged from secondary battery 53 as necessary. In other words, the power supply control earns the discharging time of secondary battery 53 and keeps discharging of secondary battery 53 continuously for the predetermined period as essentially expected. CPU 20 cuts off power supply as necessary such that the charge voltage of secondary battery 53 attains the charge start threshold value B at time t1.

FIG. 6 is a graph showing an example of the charge voltage of secondary battery 53 changing over time when the power supply control is performed.

For example, as shown in FIG. 6, when the saving mode turns on at time t0, the expected charge start time is set to time t1 the predetermined period after time t0. Here, at time t0, the charge voltage of secondary battery 53 is lower than the charge end threshold voltage A and the remaining capacity of secondary battery 53 is not sufficient. Therefore, CPU 20 performs control to cut off power supply to the load having a low priority. In the example shown in FIG. 6, power supply is cut off at the time when some time has elapsed since time t0. When power supply is cut off, the consumption of power of secondary battery 53 is reduced, so that the absolute value of the slope of a line representing the transition of charge voltage becomes smaller in FIG. 6. In other words, at the time of power supply cut-off, the line is broken to form a cusp. In this manner, because of the power supply control, the charge voltage of secondary battery 53 reaches the charge start threshold value B at time t1, and charging of secondary battery 53 is started.

FIG. 7 is a graph showing another example of the charge voltage of secondary battery 53 changing over time when the power supply control is performed.

The present example differs from the example shown in FIG. 6 in that CPU 20 successively cuts off a plurality of loads over time, one by one or group by group, in increasing order of priority. In the example shown in FIG. 6, power supply is cut off one time. In the present example, as shown in FIG. 7, it can be understood that two cusps each showing the charge voltage appear between time t0 and time t1. It means that, in the present example, power supply is cut off twice. In this manner, power supply to each load is successively cut off, so that the load having a relatively high priority can be driven for a long time.

It is noted that power supply to the load having a low priority may be cut off at the start of power supply from secondary battery 53 (time t0 in FIG. 7).

An example of the priority setting will now be described. The priority of each load is set by CPU 20 based on information about the operation status of image forming apparatus 1 and the priority information (an example of association information) 27*a*. In the present embodiment, the information about the operation status of image forming apparatus 1 includes time information preset depending on the frequency of use of image forming apparatus 1 and information about the remaining capacity of secondary battery 53. The information about the operation status of image forming apparatus 1 is obtained by CPU 20. Priority information 27*a* is stored beforehand, for example, in data storage unit 27 in which the information about the operation status of image forming apparatus 1 obtained by CPU 20 is associated with the priority to be set. Specifically, CPU 20 obtains the information about the operation status of image forming apparatus 1, refers to priority information 27*a* to extract the priority corresponding to the obtained information, and sets the extracted priority as the priority of each load. In other words, the priorities are switched, for example, according to the information about the operation status of image forming apparatus 1.

FIG. 8 is a table showing an example of priority information 27*a*.

In the present embodiment, priority information 27*a* shows a list of the priorities of the loads in a case where the charge power of secondary battery 53 reaches a voltage equal to or lower than a predetermined value within a predetermined time after the start of discharging in the saving mode. In priority information 27*a*, the priorities are set in two ways depending on the time information. In priority information 27*a*, for example, the loads (power supply targets) are arranged in the rows, and the conditions as to charge power and time information are arranged in the columns. Under each condition, each load is associated with the priority to be set correspondingly.

As shown in FIG. 8, the loads are, for example, CPU (power management CPU) 20, wireless communication module 45*a*, human detection sensor 45*b*, light sensor 45*c*, display panel 13 (saving information display unit 45*d*), and a document detection sensor. It is noted that the loads are not limited thereto, and more or less loads may be included. In FIG. 8, the priorities corresponding to the loads and conditions are represented by numerals "1" to "6" in order of priorities given to the loads.

The time information includes, for example, "daytime" and "nighttime." "Daytime" is a time period during which the frequency of use of image forming apparatus 1 is relatively high. "Nighttime" is a time period during which the frequency of use of image forming apparatus 1 is relatively low. That is, the time information is information associated with the frequency of use of image forming apparatus 1. When obtaining the time information, CPU 20 determines whether it is "daytime" or "nighttime" based on the time count information by time counter unit 22 and obtains the determination result as the time information. In the present embodiment, if the time is between 8:00 and 22:00, the time information is "daytime." It is noted that the time information may be further fragmented according to day of the week and time of a day. The time information may be set even more minutely so as to be associated with business hours of the office in which image forming apparatus 1 is used. The time information is to be set according to the frequency of use of image forming apparatus 1.

CPU 20 controls, for example, the charge/discharge circuit as a target of power supply from the charge circuit in the saving mode. Wireless communication module 45*a* performs wireless communication with the outside. Human detection sensor 45*b* detects the approach of a person. Light sensor 45*c* detects on/off of the lighting. Display panel 13 displays a machine state such as energy saving information. The document detection sensor detects a document being set. In the present embodiment, power supply is basically not cut off for CPU 20 which needs to be driven with the highest priority to operate image forming apparatus 1. In other words, the priority of CPU 20 is always the highest "1."

When the time information is information indicating "daytime" and the charge power reaches a predetermined value or lower, in the example shown in FIG. 8, the priorities are set as follows: CPU 20, wireless communication module 45*a*, human detection sensor 45*b*, the document detection sensor, display panel 13, and light sensor 45*c* in decreasing order. In this case, when the power supply targets should be narrowed down, CPU 20 cuts off, first of all, power supply to light sensor 45*c*. The low priority is set because it is daytime and it is therefore assumed that the lighting turns on in the usual office. Following light sensor 45*c*, power supply to display panel 13 having the next lower priority is cut off. After that, according to this table, power supply to the document detection sensor, human detection sensor 45*b*, and wireless communication module 45*a* is cut off in this order.

On the other hand, when the time information is information indicating "nighttime" and the charge power reaches a predetermined value or lower, in the example shown in FIG. 8, the priorities are set as follows: CPU 20, light sensor 45*c*, wireless communication module 45*a*, human detection sensor 45*b*, the document detection sensor, and display panel 13 in decreasing order. In this case, when the power supply targets should be narrowed down, CPU 20 cuts off, first of all, power supply to display panel 13. The low priority is set because it is nighttime and it is therefore assumed that display panel 13 needs not be driven in the absence of users who check display panel 13. Following display panel 13, power supply to the document detection sensor is cut off. After that, according to this table, power supply to human detection sensor 45*b*, wireless communication module 45*a*, and light sensor 45*c* is cut off in this order.

It is noted that it is not necessary to assign priority individually for each load, and power supply may be cut off for each predetermined group.

Exemplary control of charging device 50 performed when priority information 27*a* is set as shown in FIG. 8 will now be described. In the present embodiment, power supply is cut off for a load having a low priority when a predetermined time has passed and the charge power reaches a predetermined value or lower. Then, after that, every time a predetermined time has passed, if the charge power reaches a predetermined value or lower, power supply is successively cut off for a load having a lower priority.

Figure 9:
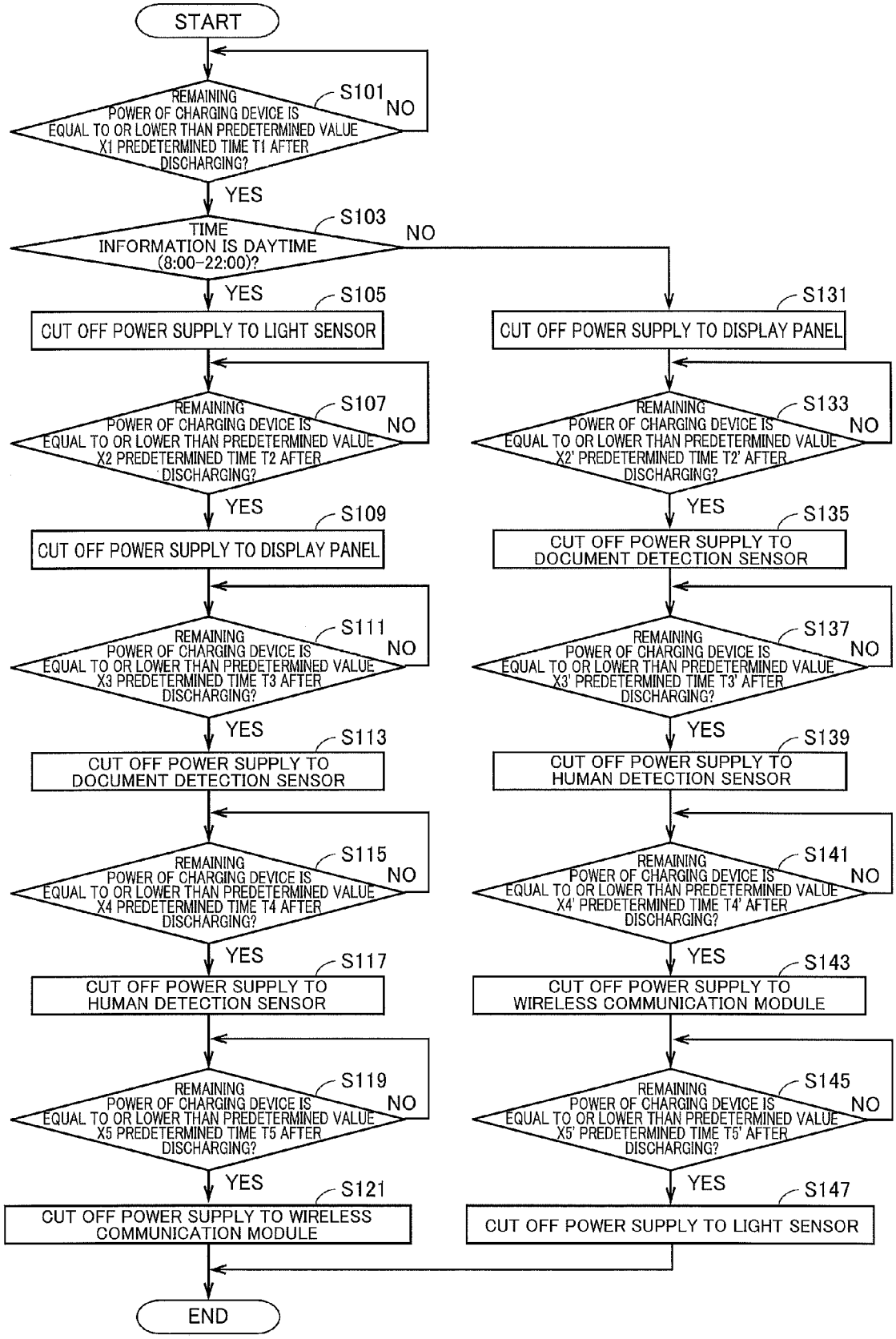
FIG. 9 is a flowchart showing an example of power supply operation of a charging device.

FIG. 9 is a flowchart showing an example of power supply operation of charging device 50.

In the following description, T1, T2, T3, T4, T5, T1', T2', T3', T4', and T5' each represent the elapsed time since discharging of secondary battery 53 is started. These times T1 to T5 and T1' to T5' each are a value of the time set considering the next charge start time. Here, T1<T2<T3<T4<T5, and T1'<T2'<T3'<T4'<T5'.

In step S101, CPU 20 determines whether the remaining power of charging device 50, that is, the remaining capacity of secondary battery 53 is equal to or lower than a predetermined value X1 when a predetermined time T1 has passed after the start of discharging. CPU 20 can make this determination, for example, by detecting the charge voltage of secondary battery 53. If the remaining capacity is not equal to or lower than the predetermined value X1, CPU 20 waits until the remaining capacity reaches the predetermined value X1 or lower.

If the remaining capacity is equal to or lower than the predetermined value X1 in step S101, in step S103, CPU 20 determines whether the time information is "daytime." The time information is obtained by CPU 20.

If the time information is "daytime" in step S103, CPU 20 sets (determines) the priority of each load in "daytime" with reference to priority information 27*a*. In other words, CPU 20 switches the priority of each load between the two ways preset as priority information 27*a*. CPU 20 then performs the process in steps S105 to S121 over time as illustrated below.

Specifically, in step S105, CPU 20 cuts off power supply to light sensor 45*c* which is the load determined to have the lowest priority.

In step S107, CPU 20 determines whether the remaining capacity of secondary battery 53 is equal to or lower than a predetermined value X2 when a predetermined time T2 has passed after the start of discharging. CPU 20 waits until the remaining capacity reaches the predetermined value X2.

If the remaining capacity is equal to or lower than the predetermined value X2 in step S107, in step S109, CPU 20 cuts off power supply to display panel 13 having the lower priority next to light sensor 45*c*.

In step S111, CPU 20 determines whether the remaining capacity of secondary battery 53 is equal to or lower than a predetermined value X3 when a predetermined time T3 has passed after the start of discharging. CPU 20 waits until the remaining capacity reaches the predetermined value X3.

If the remaining capacity is equal to or lower than the predetermined value X3 in step S111, in step S113, CPU 20 cuts off power supply to the document detection sensor having the lower priority next to display panel 13.

In step S115, CPU 20 determines whether the remaining capacity of secondary battery 53 is equal to or lower than a predetermined value X4 when a predetermined time T4 has passed after the start of discharging. CPU 20 waits until the remaining capacity reaches the predetermined value X4.

If the remaining capacity is equal to or lower than the predetermined value X4 in step S115, in step S117, CPU 20 cuts off power supply to human detection sensor 45*b* having the lower priority next to the document detection sensor.

In step S119, CPU 20 determines whether the remaining capacity of secondary battery 53 is equal to or lower than a predetermined value X5 when a predetermined time T5 has passed after the start of discharging. CPU 20 waits until the remaining capacity reaches the predetermined value X5.

If the remaining capacity is equal to or lower than the predetermined value X5 in step S119, in step S121, CPU 20 cuts off power supply to wireless communication module 45*a* having the lower priority next to human detection sensor 45*b*.

On the other hand, when the time information is not "daytime", that is, the time information is "nighttime" in step S103, CPU 20 determines the priority of each load in "nighttime" with reference to priority information 27*a*. Then, CPU 20 performs the process in steps S131 to S147 over time as illustrated below.

Specifically, in step S131, CPU 20 cuts off power supply to display panel 13 which is the load determined to have the lowest priority.

In step S133, CPU 20 determines whether the remaining capacity of secondary battery 53 is equal to or lower than a predetermined value X2' when a predetermined time T2' has passed after the start of discharging. CPU 20 waits until the remaining capacity reaches the predetermined value X2'.

If the remaining capacity is equal to or lower than the predetermined value X2' in step S133, in step S135, CPU 20 cuts off power supply to the document detection sensor having the lower priority next to the display panel.

In step S137, CPU 20 determines whether the remaining capacity of secondary battery 53 is equal to or lower than a predetermined value X3' when a predetermined time T3' has passed after the start of discharging. CPU 20 waits until the remaining capacity reaches the predetermined value X3'.

If the remaining capacity is equal to or lower than the predetermined value X3' in step S137, in step S139, CPU 20 cuts off power supply to human detection sensor 45*b* having the lower priority next to the document detection sensor.

In step S141, CPU 20 determines whether the remaining capacity of secondary battery 53 is equal to or lower than a predetermined value X4' when a predetermined time T4' has passed after the start of discharging. CPU 20 waits until the remaining capacity reaches the predetermined value X4'.

If the remaining capacity is equal to or lower than the predetermined value X4' in step S141, in step S143, CPU 20 cuts off power supply to wireless communication module 45*a* having the lower priority next to human detection sensor 45*b*.

In step S145, CPU 20 determines whether the remaining capacity of secondary battery 53 is equal to or lower than a predetermined value X5' when a predetermined time T5' has passed after the start of discharging. CPU 20 waits until the remaining capacity reaches the predetermined value X5'.

If the remaining capacity is equal to or lower than the predetermined value X5' in step S145, in step S147, CPU 20 cuts off power supply to light sensor 45*c* having the lower priority next to wireless communication module 45*a*.

Upon completion of the process in step S121 or step S147, a series of processing by CPU 20 ends.

In the present embodiment, every time a predetermined time has passed after the start of discharging, control is performed as necessary such that power supply is cut off. Therefore, the effect of the stopped operation of each load due to the power supply control shows up gradually. Therefore, the convenience of users is improved.

[Effects of Embodiment]

In image forming apparatus 1 configured as described above, when electric power is supplied from charging device 50, power to be supplied is reduced as necessary so that charging is started after a predetermined period has passed after the start of power supply. Since power supply is continuously performed for a predetermined period after the start of discharging of secondary battery 53, it is possible to secure the time during which power supply from a commercial power supply is not performed while power is provided by secondary battery 53 in the saving mode, without increasing the capacity of secondary battery 53 more than necessary. In the case where the energy-saving performance can be enhanced by providing the supply target with the charge power of charging device 50 rather than supplying power from a commercial power supply, image forming apparatus 1 can save more energy as the time during which power is supplied from the charging device is longer. In the present embodiment, the time during which power is supplied from charging device 50 can be prolonged, so that image forming apparatus 1 can save energy. Therefore, the manufacturing costs of charging device 50 can be reduced, and the energy-saving performance can be achieved as intended.

Cutting down power supply targets is directed to a load having a low priority set according to the frequency of use and the use status of image forming apparatus 1. Even when power supply targets are cut down, it has less effect on the users are and is unlikely to impair the users' convenience. Therefore, a high energy-saving effect can be achieved while the users' convenience is kept high.

The priorities are determined based on priority information 27*a* in which the operation status of image forming apparatus 1 is associated beforehand with the priority to be set correspondingly. Therefore, CPU 20 can easily execute the process of setting the priority.

Generally, the life of secondary battery 53 is sometimes affected by the frequency of charge. Charging a battery without using up the remaining power increases the frequency of charge and thus shortens the life of secondary battery 53. In this respect, in the present embodiment, when discharging of secondary battery 53 is performed in the saving mode, charging of secondary battery 53 is started after discharging is performed until the remaining capacity reaches a predetermined level. This decreases the frequency of battery charge and thus prolongs the life of secondary battery 53, resulting in a longer life of charging device 50.

[Modification]

The information about the operation status of image forming apparatus 1 may include, for example, information about the operation history of image forming apparatus 1.

FIG. 10 is a table showing an example of the priority information according to a modification of the present embodiment.

The priority information shown in FIG. 10 is to set the priority of each load (power supply target) in association with information combined with the use history of each load (an example of information about operation history of image forming apparatus 1) when the charge power of secondary battery 53 reaches a predetermined value or lower within a predetermined time after the start of discharging in the saving mode and when the time information is "daytime." In other words, this priority information is to set a priority under each condition in which the conditions concerning the charge voltage of secondary battery 53 and the time information is combined with the condition concerning information of use history.

In the present embodiment, CPU 20 can execute use history learning. Here, the user history learning refers to storing the combinations of use history for the loads of image forming apparatus 1 altogether as history learning information. CPU 20 can obtain the history learning information. The history learning information is generated by storing the use history for each load based on the number of times the operation of each load is detected in each use environment. In other words, the history learning information is updated by CPU 20 during use of the image forming apparatus. Therefore, the priority settings are changed accordingly.

As shown in FIG. 10, in this modification, the loads similar to those listed in the example shown in FIG. 8 are assumed as power supply targets. As to the history learning information, the three conditions are assumed: a case where the use history learning is not performed ("no use history learning") and cases where there are two patterns of history learning information ("history learning A" and "history learning B"). The priorities are set beforehand for each case. "History learning A" is the history learning information in an environment in which users frequently go to image forming apparatus 1 for direct manipulation while printing via wireless communication is less frequent. "History learning B" is the history learning information in an environment in which printing via wireless communication is frequent when compared with "history learning A."

In the case of "no use history learning" as to the history learning information, priorities are set similarly to the ease where the charge power is lower than a predetermined value and the time information is "daytime" in FIG. 8.

By contrast, in the case of "history learning A," the frequency of use of wireless communication module 45*a* is relatively low. Therefore, the priority of wireless communication module 45*a* goes down to "5" from "2" in the case of "no use history learning," and the priorities of human detection sensor 45*b*, display panel 13, and the document detection sensor go up.

In the case of "history learning B," the frequency of use of wireless communication module 45*a* is higher than in "history learning A." Therefore, the priority of wireless communication module 45*a* goes down only to "4" from "2" in the case of "no use history learning," and only the priorities of human detection sensor 45*b* and the document detection sensor go up.

With the settings of the priority information in this manner, the priority of each load is automatically set considering the information about operation history of image forming apparatus 1, so that the priorities are more suitably adapted to the use status of image forming apparatus 1. Therefore, power supply is cut off starting from the load in less demand, thereby keeping users' convenience high with the energy-saving effect.

Alternatively, CPU 20 may obtain the information other than the time information and the information about the operation status, in addition to the time information and the information about the operation status, or in place of such information, and set priorities based on the obtained information.

The information about the operation status of image forming apparatus 1 obtained by CPU 20 may include information about a PC connected to image forming apparatus 1 via a network. In this case, the priority information may be set correspondingly. For example, CPU 20 may obtain information about the number of PCs connected to image forming apparatus 1, that is, information about the number of devices connected to network 800 (connected device number information). CPU 20 may obtain information about the number of users who can connect to image forming apparatus 1 (user number information), based on user information of the connected terminal such as a PC. CPU 20 may set priorities based on the obtained connected device number information or user number information in addition to the time information or in place of the time information. For example, when the number of devices connected to network 800 or the number of users who can connect to network 800 is large, CPU 20 may perform control such that the priority of the load (for example, wireless communication module 45*a*) for use in communication via network 800 is set high.

CPU 20 may predict the future use status of image forming apparatus 1 and set priorities based on the prediction result. For example, CPU 20 may predict the dates and times or time periods in which image forming apparatus 1 is more likely to be used, based on the operation history information concerning the dates and times in which image forming apparatus was used, and may change the categories of the time information as appropriate. CPU 20 may set priority information 27*a* according to the probability of use of image forming apparatus 1, in each category of the time information. In this case, priorities are set based on priority information 27*a* whereby priorities are set according to prediction of the future use status of image forming apparatus 1.

Furthermore, CPU 20 may store the use history for each user who uses image forming apparatus 1 through direct manipulation or who uses a connected terminal such as a PC, and may change priorities each time according to the determination as to the use status of each load for each user who uses image forming apparatus 1. In this case, CPU 20 identifies a user who uses image forming apparatus 1, and predicts the future use status of image forming apparatus 1 for each identified user. Then, the priority of each load is set according to the predicted use status, and power supply is cut off in order from a load having the lowest priority. The setting of priorities can be performed automatically by CPU 20. Accordingly, the appropriate priorities can be set for each user, thereby keeping the user's convenience even higher. User identification may be performed, for example, based on the account name or user ID entered by the user as requested. Alternatively, user identification may be performed, for example, by individually identifying a PC connecting to image forming apparatus 1 to transmit a print job or by obtaining information of the user who logs in the PC.

Alternatively, CPU 20 may set priorities based on the user's setting information transmitted via network 800 or input through operation display unit 11. In this case, a user can allow execution of power supply control in the saving mode according to the priorities desired by himself/herself in view of the operation status of image forming apparatus 1, thereby further improving user's convenience. The user's setting may be made for each condition, for example, as in the case where the time information is "daytime" and the case where it is "nighttime."

Alternatively, CPU 20 may obtain environmental data information detected by a variety of environment sensors provided in image forming apparatus 1 and switch priorities based on that information. The environment sensor, may be, for example, human detection sensor 45*b*, light sensor 45*c*, or the document detection sensor as described above, although any other sensors may be used. For example, CPU 20 may switch priorities according to illumination detected by light sensor 45*c*. In this case, the priorities may be switched according to a combination of environmental data information detected by a plurality of environment sensors.

[Others]

The charging device may use a capacitor or a flywheel-type power storage device in place of a secondary battery.

The power supply control is not always performed such that the remaining capacity of the secondary battery reaches a predetermined level at the expected next charge start time of the secondary battery. For example, in sleep mode, the CPU may perform power supply successively in order from the load having a lower priority such that the remaining capacity of the secondary battery decreases gradually as compared with when such control is not performed. In this case, the timing to start charging of the secondary battery can be delayed as compared with the normal timing, thereby achieving the energy-saving effect.

The loads that serve as power supply targets for the charging device and are subjected to power supply control based on priorities are not limited to those described above. Such loads may include, for example, a cover open/close sensor for detecting open/close of the main unit cover of the image forming apparatus. An internal memory used in the image forming unit (image processing unit) may be a target of power supply control as a load receiving power supply.

A CPU different from the CPU of the image forming apparatus and intended for control of the charging device may be used in the power management unit of the charging device. In this case, the power supply target for the charging device may be controlled based on the control by the CPU of the image forming apparatus or the control by the CPU of the power management unit.

The image forming apparatus may have the user authentication function. With the user authentication function, for example, input of a password is accepted from a user through the operation display unit, and user authentication is performed based on the accepted information and an authentication database stored beforehand in a storage unit. The user authentication function allows the CPU to identify the user who uses the image forming apparatus. The CPU may store the use history of the image forming apparatus for each user authenticated by the user authentication function and predict the use status of the image forming apparatus for each user based on the stored use history.

The image forming apparatus may be any of a black-and-white or color copier, printer, facsimile machine, and a multi-function peripheral (MFP) as a combination thereof. The image forming apparatus is not restricted to the one which forms images by electrophotography, but may be the one which forms images by a so-called inkjet system.

The processes according to the foregoing embodiment may be performed by software or by using a hardware circuit.

A program for executing the processes according to the foregoing embodiment may be provided as well. The program may be recorded on a recording medium, such as a CD-ROM, flexible disk, hard disk, ROM, RAM, memory card, or the like, so as to be provided to the user. The program may also be downloaded to the apparatus via a communication line such as the Internet. The processes described in conjunction with the flowcharts above are executed by a CPU and the like in accordance with the program.

According to the present inventions, the power supply operation to a plurality of loads by the charging device is controlled based on the information about the remaining capacity of the power storage device and the priorities of power supply targets. Therefore, the present invention provides an image forming apparatus with low cost performance and with high energy-saving performance, while the capacity of the power storage device of the charging device can be reduced.

It should be understood that the embodiments described above are illustrative and non-restrictive in every respect. The scope of the present invention is defined by the terms of the claims, rather than the description above, and is intended to include any modifications within the scope and meaning equivalent to the terms of the claims.

What is claimed is:

1. An image forming apparatus comprising:

a charging device for performing charging and discharging using a power storage device;

a plurality of loads each serving as a target of power supply from said charging device and being used in operation of said image forming apparatus;

a first obtaining unit for obtaining information about a remaining capacity of said power storage device;

a second obtaining unit for obtaining information about an operation status of said image forming apparatus;

a setting unit for setting priorities for being a target of power supply from said charging device for said plurality of loads, according to the information obtained by said second obtaining unit; and a control unit for performing control of power supply operation of said charging device according to the information obtained by said first obtaining unit and the priorities set by said setting unit;

wherein the information about an operation status of said image forming apparatus includes time information preset according to frequency of use of said image forming apparatus.

2. The image forming apparatus according to claim 1, wherein the information about an operation status of said image forming apparatus also includes information about a remaining capacity of said power storage device.

3. An image forming apparatus, comprising:

a charging device for performing charging and discharging using a power storage device;

a plurality of loads each serving as a target of power supply from said charging device and being used in operation of said image forming apparatus;

a first obtaining unit for obtaining information about a remaining capacity of said power storage device;

a second obtaining unit for obtaining information about an operation status of said image forming apparatus;

a setting unit for setting priorities for being a target of power supply from said charging device for said plurality of loads, according to the information obtained by said second obtaining unit; and a control unit for performing control of power supply operation of said charging device according to the information obtained by said first obtaining unit and the priorities set by said setting unit;

wherein the information about an operation status of said image forming apparatus includes user setting information set by a user of said image forming apparatus.

4. The image forming apparatus according to claim 1, wherein the information about an operation status of said image forming apparatus also includes information about operation history of said image forming apparatus.

5. An image forming apparatus, comprising:

a charging device for performing charging and discharging using a power storage device;

a plurality of loads each serving as a target of power supply from said charging device and being used in operation of said image forming apparatus;

a first obtaining unit for obtaining information about a remaining capacity of said power storage device;

a second obtaining unit for obtaining information about an operation status of said image forming apparatus;

a setting unit for setting priorities for being a target of power supply from said charging device for said plurality of loads, according to the information obtained by said second obtaining unit; and a control unit for performing control of power supply operation of said charging device according to the information obtained by said first obtaining unit and the priorities set by said setting unit;

wherein the information about an operation status of said image forming apparatus includes information detected by an environment sensor provided in said image forming apparatus.

6. The image forming apparatus according to claim 1, wherein said setting unit has association information in which the information obtained by said second obtaining unit is associated beforehand with said priorities to be set, and said setting unit sets said priorities based on the information obtained by said second obtaining unit and said association information.

7. The image forming apparatus according to claim 1, wherein said control unit performs said control such that the remaining capacity of said power storage device reaches a predetermined level at an expected next charge start time of said power storage device.

8. An image forming apparatus comprising:

a charging device for performing charging and discharging using a power storage device;

a plurality of loads each serving as a target of power supply from said charging device and being used in operation of said image forming apparatus;

a first obtaining unit for obtaining information about a remaining capacity of said power storage device;

a second obtaining unit for obtaining information about an operation status of said image forming apparatus;

a setting unit for setting priorities for being a target of power supply from said charging device for said plurality of loads, according to the information obtained by said second obtaining unit;

a control unit for performing control of power supply operation of said charging device according to the information obtained by said first obtaining unit and the priorities set by said setting unit; and a third obtaining unit for obtaining information about a number of devices connected to a network to which said image forming apparatus is connected, wherein said setting unit sets said priorities according to the information obtained by said third obtaining unit.

9. An image forming apparatus comprising:

a charging device for performing charging and discharging using a power storage device;

a plurality of loads each serving as a target of power supply from said charging device and being used in operation of said image forming apparatus;

a first obtaining unit for obtaining information about a remaining capacity of said power storage device;

a second obtaining unit for obtaining information about an operation status of said image forming apparatus;

a setting unit for setting priorities for being a target of power supply from said charging device for said plurality of loads, according to the information obtained by said second obtaining unit;

a control unit for performing control of power supply operation of said charging device according to the information obtained by said first obtaining unit and the priorities set by said setting unit; and a first prediction unit for predicting a future use status of said image forming apparatus, wherein said setting unit sets said priorities based on a result of prediction by said first prediction unit.

10. An image forming apparatus comprising:

a charging device for performing charging and discharging using a power storage device;

a plurality of loads each serving as a target of power supply from said charging device and being used in operation of said image forming apparatus;

a first obtaining unit for obtaining information about a remaining capacity of said power storage device;

a second obtaining unit for obtaining information about an operation status of said image forming apparatus;

a setting unit for setting priorities for being a target of power supply from said charging device for said plurality of loads, according to the information obtained by said second obtaining unit;

a control unit for performing control of power supply operation of said charging device according to the information obtained by said first obtaining unit and the priorities set by said setting unit;

an identification unit for identifying a user who uses said image forming apparatus; and a second prediction unit for predicting a future use status of said image forming apparatus for each user identified by said identification unit, wherein said setting unit sets said priorities based on a result of identification by said identification unit and a result of prediction by said second prediction unit.

11. A control method for an image forming apparatus, said image forming apparatus including a charging device for performing charging and discharging using a power storage device, and a plurality of loads each serving as a target of power supply from said charging device and being used in operation of said image forming apparatus, said control method comprising:

a first obtaining step of obtaining information about a remaining capacity of said power storage device;

a second obtaining step of obtaining information about an operation status of said image forming apparatus, wherein the information about the operation status of said image forming apparatus includes time information preset according to frequency of use of said image forming apparatus;

a setting step of setting priorities for being a target of power supply from said charging device for said plurality of loads, according to the information obtained by said second obtaining step; and a control step of controlling power supply operation of said charging device according to the information obtained by said first obtaining step and the priorities set by said setting step.

12. A non-transitory computer-readable recording medium for controlling an image forming apparatus, the computer-readable recording medium having a program causing a computer to execute processing, said image forming apparatus including a charging device for performing charging and discharging using a power storage device, and a plurality of loads each serving as a target of power supply from said charging device and being used in operation of said image forming apparatus, said program causing a computer to execute processing comprising:

a first obtaining step of obtaining information about a remaining capacity of said power storage device;

a second obtaining step of obtaining information about an operation status of said image forming apparatus, wherein the information about the operation status of said image forming apparatus includes time information preset according to frequency of use of said image forming apparatus;

a setting step of setting priorities for being a target of power supply from said charging device for said plurality of loads, according to the information obtained by said second obtaining step; and a control step of controlling power supply operation of said charging device according to the information obtained by said first obtaining step and the priorities set by said setting step.

* * * * *